US008991969B2

(12) United States Patent
Bannai et al.

(10) Patent No.: US 8,991,969 B2
(45) Date of Patent: Mar. 31, 2015

(54) APPARATUS AND METHOD FOR CONTROLLING A RECORDING HEAD FOR RECORDING ONTO A RECORDING MEDIUM

(75) Inventors: Nobuyuki Bannai, Machida (JP); Hideyuki Kido, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 359 days.

(21) Appl. No.: 12/824,021

(22) Filed: Jun. 25, 2010

(65) Prior Publication Data

US 2010/0328390 A1 Dec. 30, 2010

(30) Foreign Application Priority Data

Jun. 30, 2009 (JP) ..... 2009-155670

(51) Int. Cl.
*B41J 29/393* (2006.01)

(52) U.S. Cl.
CPC ..... *B41J 29/393* (2013.01)
USPC ..... 347/19

(58) Field of Classification Search
USPC ..... 347/1–109
See application file for complete search history.

(56) References Cited

U.S. PATENT DOCUMENTS 6,076,915 A * 6/2000 Gast et al. ..... 347/19
6,082,911 A 7/2000 Murakami
6,219,517 B1 * 4/2001 Takahashi et al. ..... 399/301
6,283,570 B1 * 9/2001 Komiya et al. ..... 347/15
6,404,517 B1 * 6/2002 Chao ..... 358/504
6,408,156 B1 * 6/2002 Miyazaki et al. ..... 399/301
6,554,390 B2 * 4/2003 Arquilevich et al. ..... 347/19
6,700,593 B2 * 3/2004 Otsuki ..... 346/19
6,883,892 B2 * 4/2005 Sievert et al. ..... 347/19
6,886,904 B2 * 5/2005 Otsuki ..... 347/19

(Continued)

FOREIGN PATENT DOCUMENTS

JP H02-092668 A 4/1990
JP 7081190 A 3/1995

(Continued)

OTHER PUBLICATIONS

Data and Error Analysis, University of Arizona Physics Department Downloaded from http://www.physics.arizona.edu/physics/gdresources/documents/Appendix_%202_Data_analysis.pdf.*

*Primary Examiner* — Jannelle M Lebron
*Assistant Examiner* — Jeremy Bishop
(74) *Attorney, Agent, or Firm* — Canon U.S.A., Inc. IP Division

(57) ABSTRACT

The present invention includes a recording control unit configured to record a recording position adjustment chart including a pattern for adjusting a recording position of a recording head for discharging ink, and a determination unit configured to determine an adjustment value for adjusting the recording position based on data of the pattern included in the recording position adjustment chart read as image data, in which the recording position adjustment chart includes a mark for detecting an inclination in reading the recording position adjustment chart.

16 Claims, 12 Drawing Sheets

(56) References Cited

U.S. PATENT DOCUMENTS

| | | | | |
|---|---|---|---|---|
| 7,006,246 | B1 * | 2/2006 | Nakajima | 358/1.9 |
| 7,071,956 | B2 * | 7/2006 | Conrow et al. | 347/116 |
| 7,420,719 | B2 * | 9/2008 | Mongeon | 358/504 |
| 7,568,781 | B2 * | 8/2009 | Yoshida et al. | 347/19 |
| 7,571,978 | B2 * | 8/2009 | Nakano et al. | 347/19 |
| 7,726,765 | B2 * | 6/2010 | Yoshida et al. | 347/19 |
| 7,735,949 | B2 * | 6/2010 | Takahashi et al. | 347/14 |
| 7,760,370 | B2 * | 7/2010 | Oki | 358/1.1 |
| 7,784,897 | B2 * | 8/2010 | Fletcher et al. | 347/19 |
| 2003/0133000 | A1 * | 7/2003 | Conrow et al. | 347/116 |
| 2005/0270325 | A1 * | 12/2005 | Cavill et al. | 347/19 |
| 2009/0021551 | A1 * | 1/2009 | Fletcher et al. | 347/19 |

FOREIGN PATENT DOCUMENTS

| | | | |
|---|---|---|---|
| JP | H10-315560 | A | 12/1998 |
| JP | 2006056077 | A | 3/2006 |
| JP | 2006293213 | A | 10/2006 |
| JP | 2006305952 | A | 11/2006 |

* cited by examiner

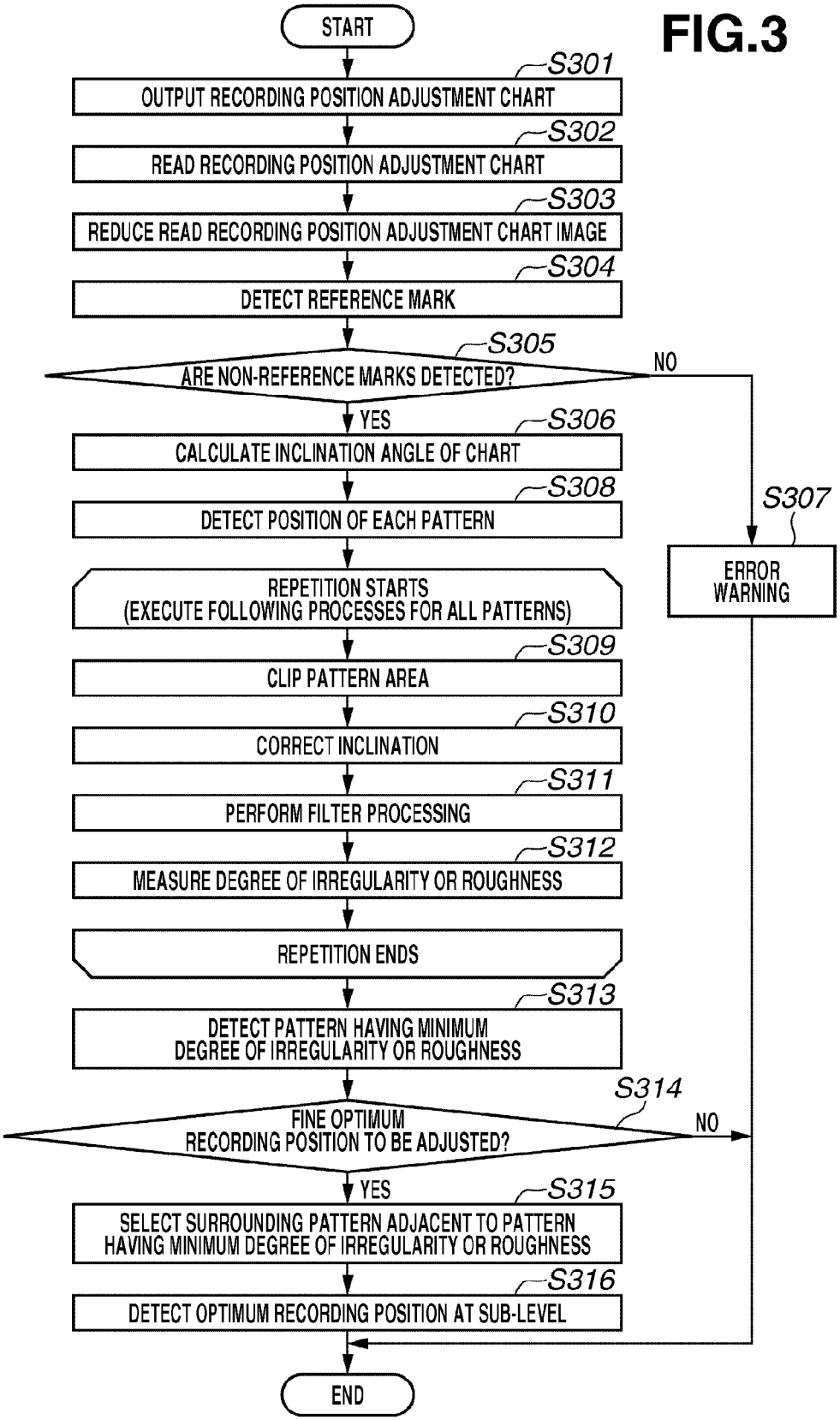
FIG.3
START
S301
OUTPUT RECORDING POSITION ADJUSTMENT CHART
S302
READ RECORDING POSITION ADJUSTMENT CHART
S303
REDUCE READ RECORDING POSITION ADJUSTMENT CHART IMAGE
S304
DETECT REFERENCE MARK
S305
ARE NON-REFERENCE MARKS DETECTED?
NO
YES
S306
CALCULATE INCLINATION ANGLE OF CHART
S308
DETECT POSITION OF EACH PATTERN
S307
ERROR WARNING
REPETITION STARTS
(EXECUTE FOLLOWING PROCESSES FOR ALL PATTERNS)
S309
CLIP PATTERN AREA
S310
CORRECT INCLINATION
S311
PERFORM FILTER PROCESSING
S312
MEASURE DEGREE OF IRREGULARITY OR ROUGHNESS
REPETITION ENDS
S313
DETECT PATTERN HAVING MINIMUM
DEGREE OF IRREGULARITY OR ROUGHNESS
S314
FINE OPTIMUM
RECORDING POSITION TO BE ADJUSTED?
NO
YES
S315
SELECT SURROUNDING PATTERN ADJACENT TO PATTERN
HAVING MINIMUM DEGREE OF IRREGULARITY OR ROUGHNESS
S316
DETECT OPTIMUM RECORDING POSITION AT SUB-LEVEL
END

APPARATUS AND METHOD FOR CONTROLLING A RECORDING HEAD FOR RECORDING ONTO A RECORDING MEDIUM

BACKGROUND OF THE INVENTION

1. Field of the Invention

The present invention relates to an image processing apparatus for adjusting a recording position of a recording head for discharging ink, and an image processing system, and an image processing method.

2. Description of the Related Art

In an inkjet recording apparatus, an ink impact position (a recording position) on a recording medium such as recording paper may be shifted due to a mounting error of a recording head for discharging ink or a manufacturing error in a process of manufacturing the recording head. The shift in the recording position includes a shift in a recording position between a monochrome chip and a color chip, a shift in a recording position between forward recording and backward recording in a predetermined nozzle array, and a shift in a recording position between different passes in multi-pass recording.

Regarding the above-mentioned issue, Japanese Patent Application Laid-Open No. 10-315560 discusses a method for adjusting a shift in a recording position. In a technique discussed in Japanese Patent Laid-Open No. 10-315560, a recording position adjustment chart including a ruled line pattern recording a reference line and a non-reference line with a plurality of shifting amounts, and a dot pattern recording a reference patch and a non-reference patch with a plurality of shifting amounts is output. The recording position adjustment chart which is output is read as image data with a scanner, to determine a reference position adjustment value based on a shifting amount in which a shift between the reference line and the non-reference line is smallest and an average density difference in the dot pattern is smallest.

In the method discussed in Japanese Patent Application Laid-Open No. 10-315560, if the recording position adjustment chart is placed inclining on a document positioning plate when read by the scanner, the density (luminance) of the dot pattern cannot be accurately measured under the influence of shaggy or the like, so that an error occurs in the recording position adjustment value.

SUMMARY OF THE INVENTION

According to an aspect of the present invention, an image processing apparatus includes a recording control unit configured to cause a recording head for discharging ink to record a recording position adjustment chart including at least one pattern for adjusting a recording position of the recording head, a reading unit configured to read the recording position adjustment chart as image data, and a determination unit configured to determine an adjustment value for adjusting the recording position based on the recording position adjustment chart read as the image data, in which the recording position adjustment chart includes a plurality of patterns that differs in the degree of irregularity or roughness of a pixel value read by the reading unit according to a shifting amount of the recording position of the recording head, and a mark for detecting an inclination in reading the recording position adjustment chart, and the determination unit determines the adjustment value based on the degree of irregularity or roughness of each of the plurality of patterns.

According to another aspect of the present invention, an image processing apparatus includes a recording control unit configured to cause a recording head for discharging ink to record a recording position adjustment chart including a pattern for adjusting a recording position of the recording head, and a determination unit configured to determine an adjustment value for adjusting the recording position based on data relating to the pattern included in the image data from which the recording position adjustment chart is read by a reading unit, in which the recording position adjustment chart includes a plurality of patterns that differs in the degree of irregularity or roughness of a pixel value read by the reading unit according to a shift in the recording position of the recording head, and the determination unit determines the adjustment value based on an average of the degrees of irregularity or roughness for areas obtained by dividing a predetermined area inscribed in each of the plurality of patterns.

According to yet another aspect of the present invention, an image processing system includes a recording control unit configured to cause a recording head for discharging ink to record a recording position adjustment chart including at least one pattern for adjusting a recording position of the recording head, a reading unit configured to read the recording position adjustment chart as image data, and a determination unit configured to determine an adjustment value for adjusting the recording position based on the recording position adjustment chart read as the image data, in which the recording position adjustment chart includes a plurality of patterns that differs in the degree of irregularity or roughness of a pixel value read by the reading unit according to a shifting amount of the recording position of the recording head, and a mark for detecting an inclination in reading the recording position adjustment chart, and the determination unit determines the adjustment value based on the degree of irregularity or roughness of each of the plurality of patterns.

According to yet another aspect of the present invention, an image processing method includes causing a recording head for discharging ink to record a recording position adjustment chart including at least one pattern for adjusting a recording position of the recording head, reading the recording position adjustment chart as image data, and determining an adjustment value for adjusting the recording position based on the recording position adjustment chart read as the image data, in which the recording position adjustment chart includes a plurality of patterns that differs in the degree of irregularity or roughness of a pixel value according to a shifting amount of the recording position of the recording head and a mark for detecting an inclination in reading the recording position adjustment chart, and the adjustment value is determined based on the degree of irregularity or roughness of each of the plurality of patterns.

According to the present invention, even if the recording position adjustment chart is placed in an inclined position on a document positioning plate when read by a scanner, the recording position adjustment value can be accurately acquired.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 3 is a flowchart illustrating recording position adjustment processing in the first exemplary embodiment.

DESCRIPTION OF THE EMBODIMENTS

Various exemplary embodiments, features, and aspects of the invention will be described in detail below with reference to the drawings.

First, a multifunctional recording apparatus (hereinafter referred to as MFP) 100 according to a first exemplary embodiment of the present invention will be described. FIG. 11 is an external perspective view of the MFP 100.

The MFP 100 includes a printer function, a scanner function, and an external memory reading function. An inkjet recording apparatus is mounted on a printer unit (image recording unit) 103 (see FIG. 1) for implementing the printer function. An optical scanner is mounted on a scanner unit (reading unit) 104 (see FIG. 1) for implementing the scanner function.

Figure 11A:
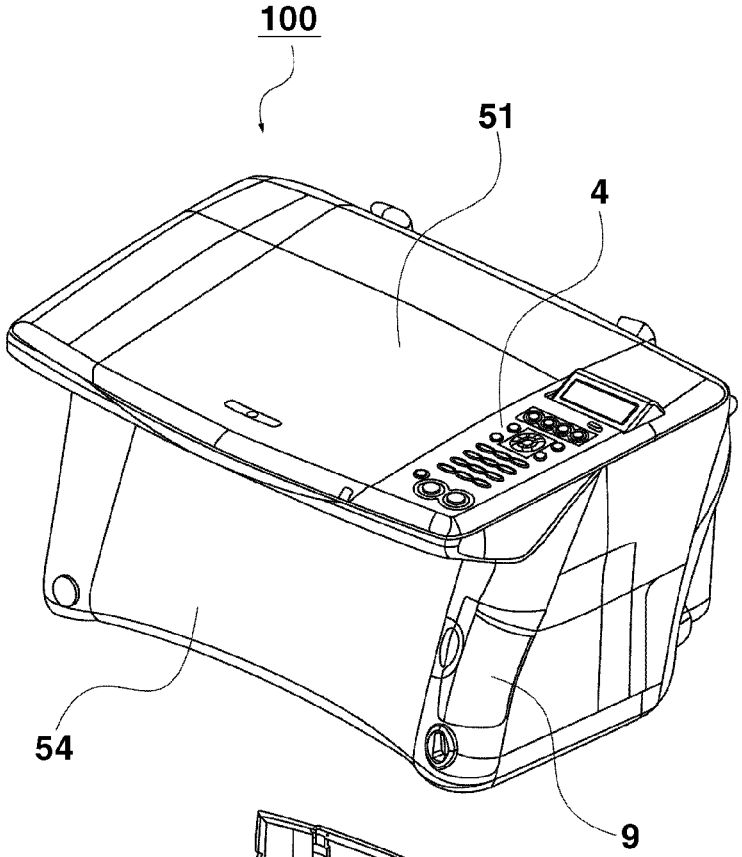
FIGS. 11A and 11B are perspective views of the appearance of the recording apparatus according to the first exemplary embodiment.
Figure 11B:
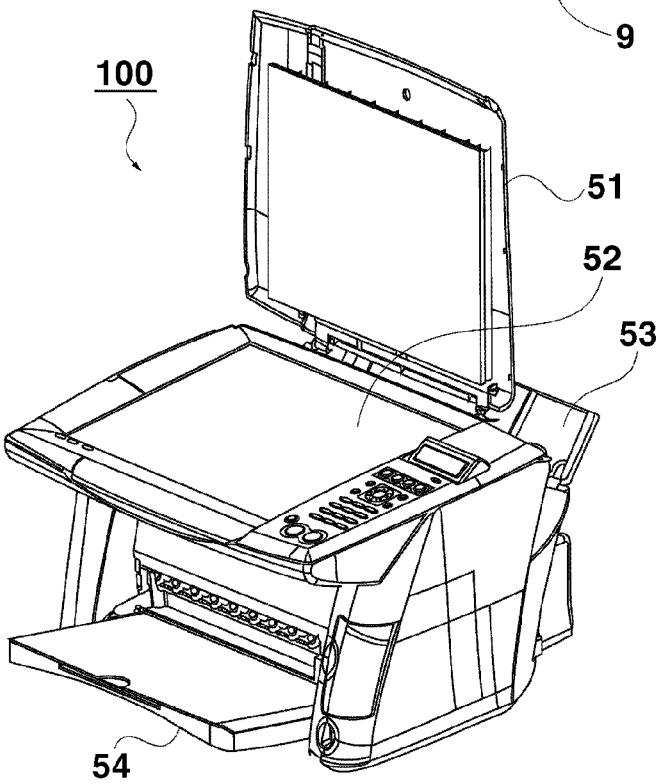

FIG. 11A illustrates a state where a document cover 51 in the scanner unit 104 and a sheet discharge tray 54 in the printer unit 103 are closed, and FIG. 11B illustrates a state where the document cover 51 is opened, so that a document positioning plate 52 for placing an image document can be seen. FIG. 11B also illustrates a state where an automatic sheet feeder (ASF) 53 for placing recording paper or the like and the paper discharge tray 54 are opened. The scanner unit 104 includes a charge coupled device (CCD), and reads a document image from the CCD, and outputs analog luminance signals in red (R), green (G), and blue (B). The scanner unit 104 may use a contact image sensor (CIS) in place of the CCD.

In FIG. 11, the MFP 100 includes an operation unit 4 including a plurality of keys and buttons and a display unit (a liquid crystal display (LCD)) 5 at its upper right, and a card interface (I/F) unit 9 at the center of its right side surface. A memory card storing an image file that is captured by a digital still camera and is recorded, for example, can be inserted into the card I/F unit 9. A user performs a predetermined operation from the operation unit 4, to read the image file stored in the memory card in the MFP 100. The printer unit 103 in the MFP 100 can record an image.

Figure 12:
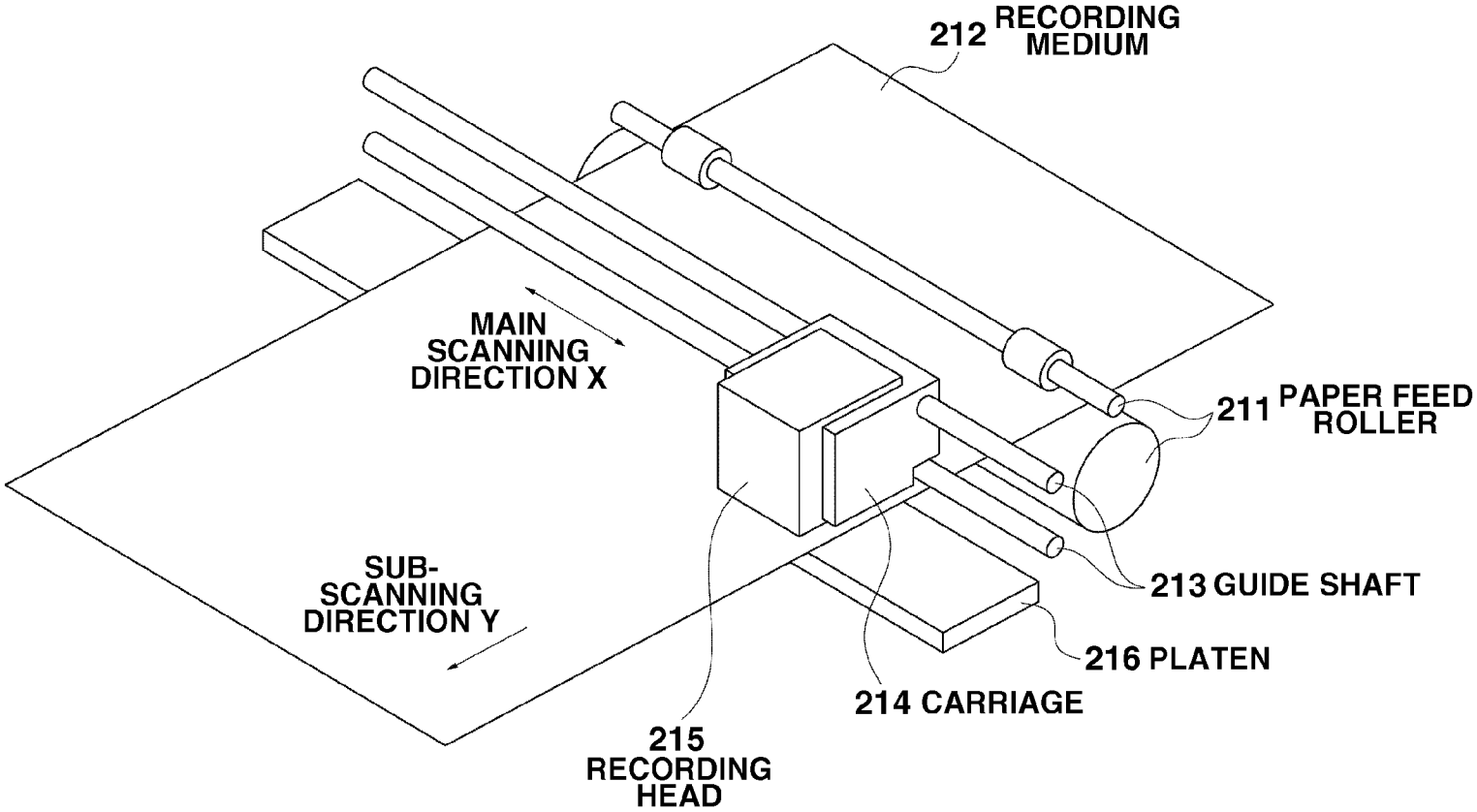
FIG. 12 illustrates a configuration of a recording unit in the first exemplary embodiment.

FIG. 12 is a perspective view illustrating a configuration of the printer unit (inkjet recording apparatus) 103. A paper feed roller pair 211 rotates with a recording medium 212 sandwiched between two rollers, and conveys the recording medium 212 in a sub-scanning direction. A platen 216 supports an area, on which recording is to be performed, of the recording medium 212 to be conveyed from below, and keeps a proper distance between the recording medium 212 and a discharge port surface of a recording head 215.

The recording head 215 is detachably attached to a carriage 214 that moves along a guide shaft 213, and discharges ink droplets from a plurality of discharge ports (also referred to as nozzles) based on a recording signal while moving in a main scanning direction. Thus, the recording medium 212 is subjected to recording corresponding to a single scanning/recording operation. When the scanning/recording operation is performed once, the recording medium 212 is conveyed in a sub-scanning direction by an amount corresponding to the recording width of the recording head 215. Such a scanning/recording operation and a conveying operation are alternately repeated so that an image is sequentially formed on the recording medium 212. Two chips, i.e., a monochrome chip and a color chip are provided on the discharge port surface of the recording head 215, and a black nozzle array for discharging black ink is disposed in the monochrome chip. Three nozzle arrays for discharging cyan ink, magenta ink, and yellow ink are respectively arranged in a main scanning direction in the color chip.

The ink discharged by the recording head 215 is supplied from an ink supply device (not illustrated) fixed in the MFP 100. The MFP 100 also includes a recording medium supply unit for supplying the recording medium 212 before recording, to the paper feed roller pair 211, and a recording medium discharge unit for discharging the recording medium 212 after recording. Further, the MFP 100 can include a recovery unit for maintaining the recording head 215, a preliminary auxiliary unit, and so on to stably obtain the effect of the present invention. These units include a capping unit for capping the discharge port surface of the recording head 215, a cleaning unit for wiping a foreign substance or the like on the discharge port surface, a unit for pressurizing or sucking the inside of the discharge port, and a unit for receiving ink preliminarily discharged.

Figure 1:
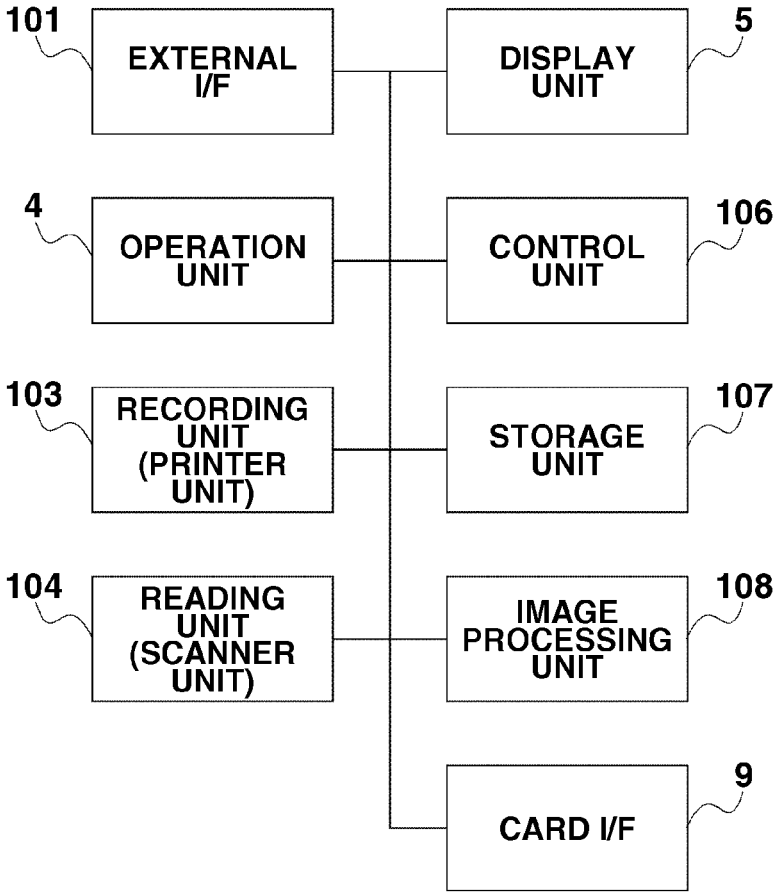
FIG. 1 is block diagram illustrating a control configuration of a recording apparatus according to a first exemplary embodiment.

FIG. 1 is a block diagram of the MFP 100. A universal serial bus (USB) connector to be connected to an external apparatus (a personal computer (PC)) is mounted on an external interface (I/F) unit 101. The external I/F unit 101 may include an infrared Data Association (IrDA) receiver serving as a non-contact interface. A control unit 106 corresponds to a so-called central processing unit (CPU) or microprocessor unit (MPU), and controls the units in the MFP 100, i.e., the operation unit 4, the display unit 5, the card I/F unit 9, the external I/F unit 101, the printer unit 103, and the scanner unit 104. Further, the control unit 106 acquires the state of the MFP 100 using each of various sensors while controlling the operation of each of the units in image processing by an image processing unit 108 described below.

A storage unit 107 stores image data input via the card I/F unit 9, the external I/F unit 101, or the scanner unit 104. Further, the storage unit 107 has the function of storing various programs and data for executing recording position adjustment processing described below, and an adjustment value found by the recording position adjustment processing. The storage unit 107 is also used as a work area and a registration area for various setting items, as needed, to execute control. The image processing unit 108 controls recording of the MFP 100, executes document area detection processing for the image data stored in the storage unit 107, and executes print data generation processing for recording an image from the image data.

Figure 2:
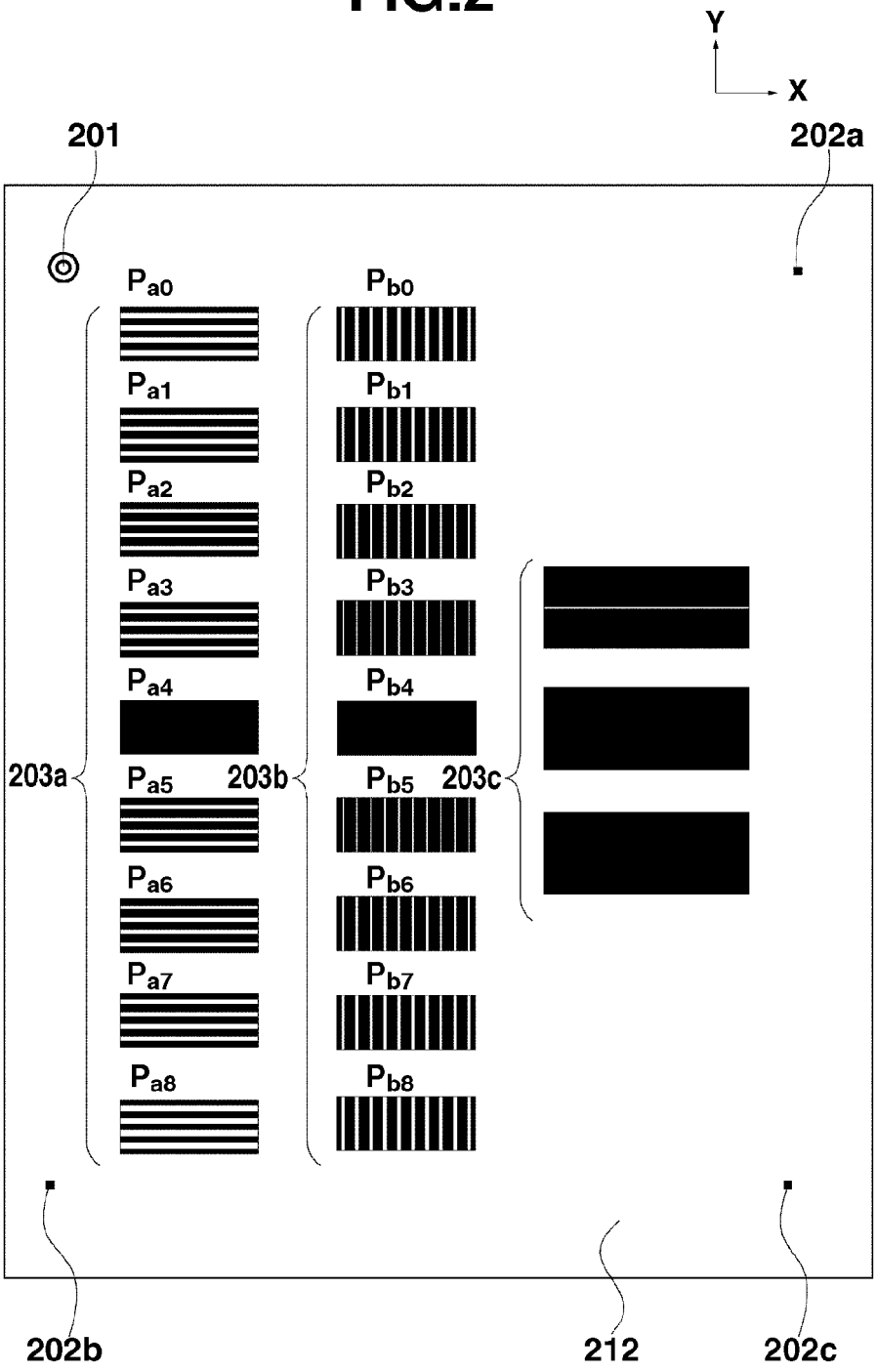
FIG. 2 illustrates a recording position adjustment chart in the first exemplary embodiment.

FIG. 2 illustrates a recording position adjustment chart in the present exemplary embodiment, where the horizontal direction is a main scanning direction x of the recording head 215, and the vertical direction is a conveyance direction y of the recording medium 212. A reference mark 201 is used to identify the recording medium 212 recording the recording position adjustment chart. If the reference mark 201 can be detected at the upper left of the image data read by the scanner unit 104, the recording medium 212 can be identified as the medium recording the recording position adjustment chart. In the present exemplary embodiment, the processing can proceed to a next process subsequent to recording position adjustment processing, provided that the reference mark 201 is detected. Non-reference marks 202*a* to 202*c* are used to detect an inclination angle of the chart, and a positional relationship up to recording position adjustment patterns 203*a* to 203*c* based on a positional relationship to the reference mark 201.

In the recording position adjustment chart in the present exemplary embodiment, recording position adjustment patterns relating to a plurality of adjustment items are recorded. The recording position adjustment pattern 203*a* is used to adjust a recording position between the monochrome chip and the color chip on the recording head 215. The recording position adjustment chart also includes the recording position adjustment pattern 203*b* between forward recording and backward recording in a predetermined nozzle array (e.g., a cyan array), and the recording position adjustment pattern 203*c* between different passes in multi-pass recording. The recording position adjustment pattern 203*a* between the monochrome chip and the color chip includes nine patterns $P_{a0}$ to $P_{a8}$, and the recording position adjustment pattern 203*b* between forward recording and backward recording includes nine patterns $P_{b0}$ to $P_{b8}$. The recording position adjustment pattern 203*c* between different passes includes three patterns $P_{c0}$ to $P_{c2}$.

Each of the recording position adjustment patterns includes a plurality of patterns, which is made to differ in optical characteristic (luminance) by changing ink discharge timing in one of different recording operations with respect to that in the other recording operation at predetermined intervals. The recording position adjustment pattern 203*a*, for example, includes a plurality of patterns, which is differentiated in optical characteristic (luminance) by shifting ink discharge timing in the cyan nozzle array in the color chip relative to the black nozzle array in the monochrome chip. The degree at which ink discharge timing in one of different recording operations is shifted relative to the other recording operation is also referred to as a shifting amount.

A luminance variation (a fringe pattern) occurs in a pattern included in each of recording position adjustment patterns if its recording position is shifted. In recording position adjustment processing, a pattern that least varies in luminance (a uniform pattern with no fringe) is detected. A recording position of the pattern can be adjusted to its optimum recording position based on ink discharge timing (a shifting amount) at which the pattern has been recorded. More specifically, in the recording position adjustment processing, the ink discharge timing (shifting amount) of the pattern at the optimum recording position corresponds to an adjustment value for adjusting a shift in the recording position. The recording position can also be adjusted by calculating an approximate equation based on a luminance variation (a degree of irregularity or roughness, described below) of a pattern in each of adjustment items, to determine the adjustment value in finer units than a shifting amount in which the pattern in the adjustment item is recorded. The details will be described below.

FIG. 3 is a flowchart illustrating recording position adjustment processing according to the present exemplary embodiment. If a user operates the operation unit 4 in the MFP 100, to give an instruction to execute recording position adjustment processing, then in step S301, the control unit 106 reads out data relating to a recording position adjustment chart from the storage unit 107, and outputs the recording position adjustment chart. Alternatively, the recording position adjustment processing may be automatically performed when power to the MFP 100 is first turned on or when the recording head 215 is exchanged. When the recording position adjustment chart is output, the user checks whether the recording position adjustment chart is contaminated or whether dots fall off due to ink non-discharge in each of patterns in the chart. When the recording position adjustment chart has no problem, the user places the recording position adjustment chart on the document positioning plate 52, and closes the document cover 51.

If the user operates the operation unit 4, to give an instruction to read the recording position adjustment chart, then in step S302, the control unit 106 causes the scanner unit 104 to start to read the recording position adjustment chart under conditions such as a gray scale, a reading resolution of 600 dpi, and γ correction (γ=1.0).

In step S303, the control unit 106 causes the image processing unit 108 to reduce the read recording position adjustment chart to image data having a resolution of 300 dpi while subjecting the chart to bilinear correction, and stores the obtained image data in the storage unit 107. In the present exemplary embodiment, the image processing unit 108 reads the recording position adjustment chart at a resolution of 600 dpi, and then reduces the recording position adjustment chart to image data having a resolution of 300 dpi while subjecting the chart to bilinear correction. When the recording position adjustment chart is directly read at a resolution of 300 dpi, moiré may be generated by interference with a fringe in the pattern included in the chart, which may affect determination of a recording position adjustment value.

In step S304, the control unit 106 detects whether the reference mark 201 exists at the upper left of the image data stored in the storage unit 107, by pattern matching. The control unit 106 searches for a pixel pattern in white, black, white, . . . , to detect the reference mark 201, and at the same time detects a central position of the reference mark 201. If the reference mark 201 is not detected (NO in step S304), the processing proceeds to step S307. In step S307, the control unit 106 displays an error warning on the display unit 5, to terminate the processing. If the reference mark 201 is detected (YES in step S304), the processing proceeds to step S305.

In step S305, the control unit 106 detects the non-reference marks 202*a* to 202*c*. A method for detecting the non-reference marks 202*a* to 202*c* uses pattern matching, similarly to the method for detecting the reference mark 201. If the control unit 106 has failed to detect any one of the non-reference marks 202*a* to 202*c* (NO in step S305), the processing proceeds to step S307. In step S307, the control unit 106 displays an error warning on the display unit 5, to terminate the processing. If the control unit 106 has succeeded in detecting all the non-reference marks 202*a* to 202*c* (YES in step 305), the processing proceeds to step S306.

In step S306, the control unit 106 calculates an inclination angle of the recording position adjustment chart from positions of the reference mark 201 detected in step S304 and the non-reference marks 202*a* to 202*c* detected in step S305. For example, an inclination angle θ of the recording position adjustment chart can be calculated by the following equation (1), where $(x_{m0}, y_{m0})$ is a detection position of the reference mark 201, and $(x_{m1}, y_{m1})$ is a detection position of the non-reference mark 202*a*:

$$\theta = \tan^{-1}\left(\frac{y_{m1} - y_{m0}}{x_{m1} - x_{m0}}\right) \tag{1}$$

In step S308, the control unit 106 then detects respective upper left coordinate positions of the patterns $P_{a0}$ to $P_{a8}$, $P_{b0}$ to $P_{b8}$, and $P_{c0}$ to $P_{c2}$. The storage unit 107 holds data relating to distances in the x-direction and the y-direction from the reference mark 201 to the upper left coordinate position of each of the patterns when the reference position adjustment chart is not inclined. The control unit 106 calculates the upper left coordinate position of each of the patterns by affine transformation using the coordinate position $(x_{m0}, y_{m0})$ of the reference mark 201 detected in step S304 and the inclination angle θ of the reference position adjustment chart calculated in the equation (1). For example, coordinates $(x_p', y_p')$ after affine transformation can be expressed by the following equation (2), where $(x_p, y_p)$ is an upper left coordinate position of a mark, and $l_x$ and $l_y$ are respectively distances in the x-direction and the y-direction of the mark from the reference mark 201:

$$\begin{pmatrix} x_p' \\ y_p' \\ 1 \end{pmatrix} = \begin{pmatrix} 1 & 0 & (x_{m0} + l_x) \\ 0 & 1 & (y_{m0} + l_y) \\ 0 & 0 & 1 \end{pmatrix} \begin{pmatrix} \cos\theta & -\sin\theta & 0 \\ \sin\theta & \cos\theta & 0 \\ 0 & 0 & 1 \end{pmatrix} \begin{pmatrix} 1 & 0 & -(x_{m0} + l_x) \\ 0 & 1 & -(y_{m0} + l_y) \\ 0 & 0 & 1 \end{pmatrix} \begin{pmatrix} x_p \\ y_p \\ 1 \end{pmatrix} \tag{2}$$

In step S309, the control unit 106 clips, based on the upper left coordinate position of each of the patterns calculated in step S308, a rectangular area that circumscribes the pattern.

Figure 4:
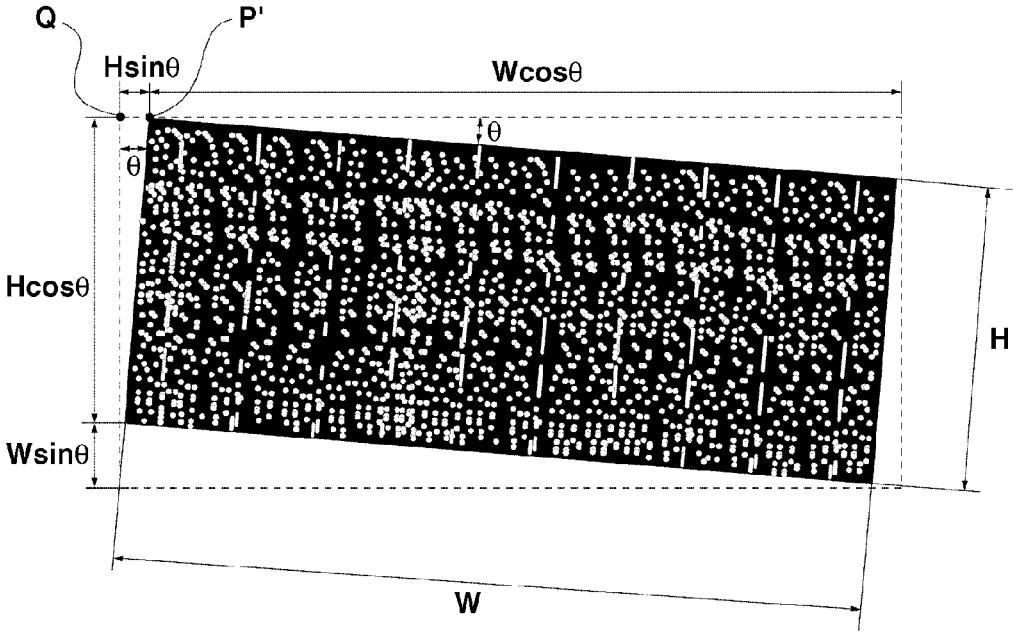
FIG. 4 illustrates a method for clipping a rectangular area in the first exemplary embodiment.

FIG. 4 illustrates a method for clipping the rectangular area that circumscribes the pattern. Where P' $(x_p', y_p')$ is an upper left coordinate position of a pattern after affine transformation, and W and H are respectively the width and the height of the pattern, a rectangular area having a width (H sin θ+W cos θ) and a height (H cos θ+W sin θ) may be clipped from a position Q $(x_p', -H \sin\theta, y_p')$. In step S310, the control unit 106 performs inclination correction for the pattern area clipped in step S309. The pattern area is rotated −θ by affine transformation, as in step S308, around the point P' illustrated in FIG. 4 as a rotation center.

In step S311, the control unit 106 performs filter processing so that an embossing effect is obtained for image data in an area having a width W and a height H at the point P' after the inclination correction in step S310 as the origin in order to highlight a fringe pattern generated by a shift in a recording position. In the filter processing, a filter factor to be applied is switched depending on a direction of fringes generated in a pattern.

A filter factor 1, described below, is applied to patterns in which horizontal fringes are generated, such as the recording position adjustment pattern 203*a* between the monochrome chip and the color chip, and the recording position adjustment pattern 203*c* between the passes:

$$\begin{pmatrix} 1 & 1 & 1 \\ 0 & 0 & 0 \\ -1 & -1 & -1 \end{pmatrix} \quad \text{(Filter Factor 1)}$$

On the other hand, a filter factor 2, described below, is applied to patterns in which vertical fringes are generated, such as the recording position adjustment pattern 203*b* between forward recording and backward recording.

$$\begin{pmatrix} -1 & 0 & 1 \\ -1 & 0 & 1 \\ -1 & 0 & 1 \end{pmatrix} \quad \text{(Filter Factor 2)}$$

A pixel value obtained by adding a constant c (c=128) to image data to which the filter factor 1 or the filter factor 2 is applied, as described above, is set to zero if the pixel value is less than zero, and set to 255 if it exceeds 255, to obtain image data in which a fringe pattern generated by a shift in a recording position is more highlighted.

In step S312, the control unit 106 then measures the degree of irregularity or roughness (uniformity) of a pixel value in each of the patterns. In the present exemplary embodiment, a pattern is analyzed based on the degree of irregularity or roughness of a pixel value in the pattern to determine a recording position adjustment value. Each of pixel values in the pattern area that has been subjected to the filter processing in step S311 has irregularity or roughness.

Figure 5A:
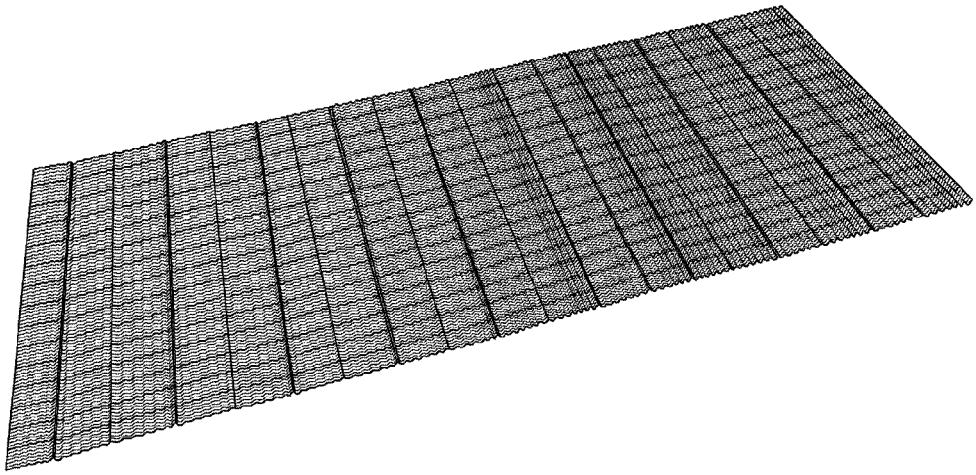
FIGS. 5A and 5B illustrate irregularity or roughness of pixel values in pattern areas.
Figure 5B:
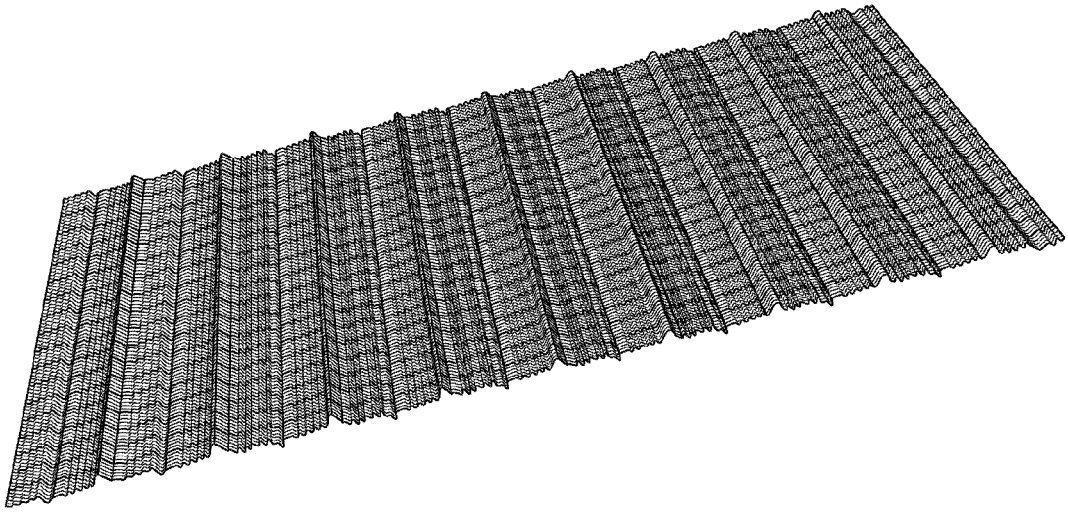

FIG. 5 illustrates irregularity or roughness of a pixel value in a pattern area. FIG. 5A illustrates a pattern in which the recording positions match, where irregularity or roughness is nearly uniform. On the other hand, FIG. 5B illustrates a pattern in which the recording position is shifted, where irregularity or roughness is non-uniform. In order to determine an adjustment value for adjusting a shift in a recording position of a pattern using such characteristics, the degree of irregularity or roughness of the pattern is measured.

Figure 6A:
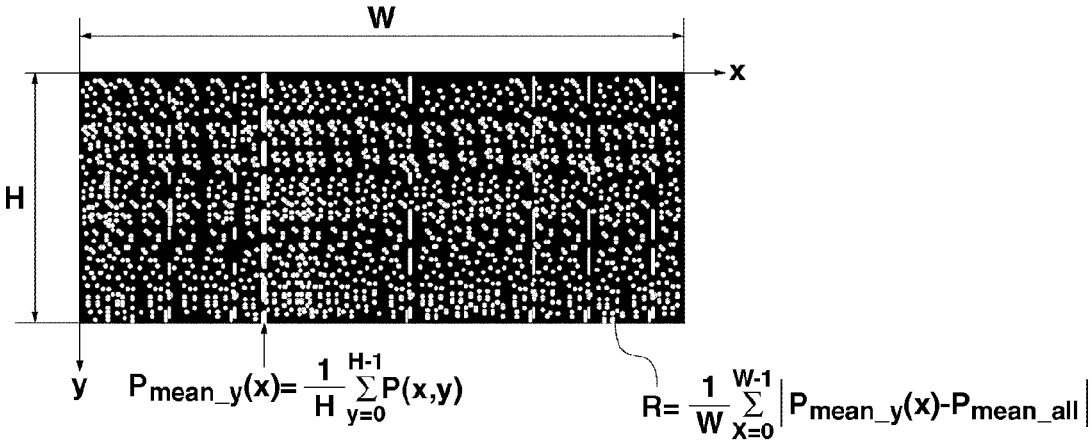
FIGS. 6A and 6B respectively illustrate methods for measuring the degrees of irregularity or roughness of patterns.
Figure 6B:
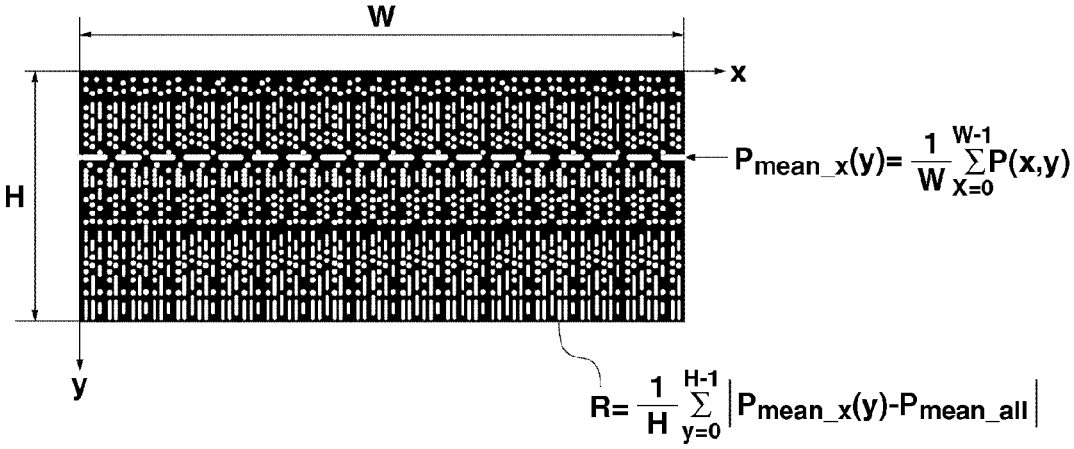

FIG. 6 illustrates a method for measuring the degree of irregularity or roughness of a pattern. FIG. 6A illustrates a method for measuring the degree of irregularity or roughness of a pattern in which vertical fringes are generated when a recording position of the pattern is shifted. FIG. 6B illustrates a method for measuring the degree of irregularity or roughness of a pattern in which horizontal fringes are generated when a recording position of the pattern is shifted.

A method for measuring the degree of irregularity or roughness of a pattern (203*b*) in which vertical fringes are generated when a recording position of the pattern is shifted will be described with reference to FIG. 6A.

First, a mean value $P_{mean_y}(x)$ of pixel values on one line in the y-axis direction in a portion having a pattern width W in the x-axis direction is measured using the following equation (3):

$$P_{mean_y}(x) = \frac{1}{H}\sum_{y=0}^{H-1} P(x, y) \tag{3}$$

Here, P (x, y) is a pixel value at a coordinate position (x, y).

The degree of irregularity and roughness R of the pattern is then measured using the following equation (4):

$$R = \frac{1}{W}\sum_{x=0}^{W-1} |P_{mean_y}(x) - P_{mean_all}| \tag{4}$$

Here, $P_{mean_all}$ is a mean value of pixel values in the whole pattern area.

A method for measuring the degree of irregularity or roughness of a pattern in which vertical fringes are generated when a recording position of the pattern is shifted will be then described with reference to FIG. 6B. First, a mean value $P_{mean_x}(y)$ of pixel values on one line in the x-axis direction in a portion having a pattern width H in the y-axis direction is measured using the following equation (5):

$$P_{mean_x}(y) = \frac{1}{W}\sum_{x=0}^{W-1} P(x, y) \tag{5}$$

Here, P (x, y) is a pixel value at a coordinate position (x, y).

The degree of irregularity or roughness R of the pattern is then measured using the following equation (6):

$$R = \frac{1}{H}\sum_{y=0}^{H-1} |P_{mean_x}(y) - P_{mean_all}| \tag{6}$$

Here, $P_{mean_all}$ is a mean value of pixel values in the whole pattern area.

When the degree of irregularity or roughness R of a pattern is measured, a mean value of pixel values on one line is used to alleviate the effect of ink non-discharge due to clogging of an ink discharge port during pattern recording, the effect of contamination due to rubbing of the recording head 215, and the effect of contamination of the document positioning plate 52 during reading as much as possible.

The above-mentioned processing in steps S309 to S312 is repeatedly performed for all the patterns in each of the adjustment items. If the degrees of irregularity or roughness R of all the patterns are measured, the processing proceeds to step S313.

In step S313, the control unit 106 searches for the pattern having the minimum degree of irregularity or roughness for each of the adjustment items, from the measured degrees of irregularity or roughness R.

Figure 7A:
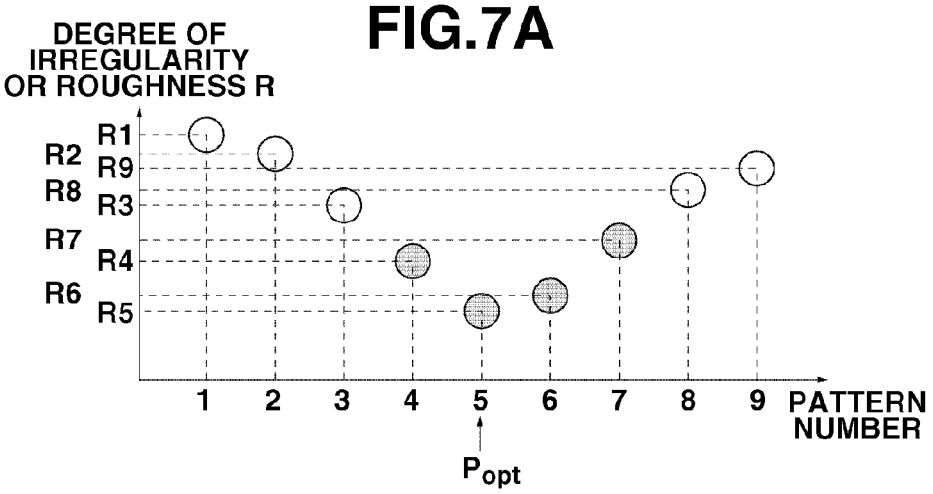
FIGS. 7A, 7B, and 7C respectively illustrate methods for selecting the degrees of irregularity or roughness of patterns.

FIG. 7 illustrates a method for selecting the degree of irregularity or roughness of a pattern. FIG. 7A is a graph illustrating the measured degrees of irregularity or roughness R of the recording position adjustment patterns $P_{a0}$ to $P_{a8}$ respectively between the monochrome chip and the color chip, for example. At this time, a recording position at which a pattern with a pattern number 5 (pattern $P_{a0}$) is recorded is the minimum degree of irregularity or roughness. Therefore, a recording position at which the pattern is recorded has an optimum value $P_{opt}$ (adjustment value). If optimum recording positions are respectively determined for all the adjustment items, the processing proceeds to step S314.

In step S314, the control unit 106 checks whether the optimum recording position is to be determined in finer units (at a sub-level) than a shifting amount in which the recording position adjustment pattern is recorded. The adjustment items for which the optimum recording positions are determined in finer units than the shifting amount in the present exemplary embodiment include recording position adjustment between the monochrome chip and the color chip and recording position adjustment between forward recording and backward recording. On the other hand, optimum recording position adjustment is not made at the sub-level for recording position adjustment between the passes. The adjustment value for the optimum recording position determined by the degree of irregularity or roughness R is stored in the storage unit 107 and the processing is terminated. If optimum recording position adjustment is made at the sub-level, the processing proceeds to step S315.

Figure 7B:
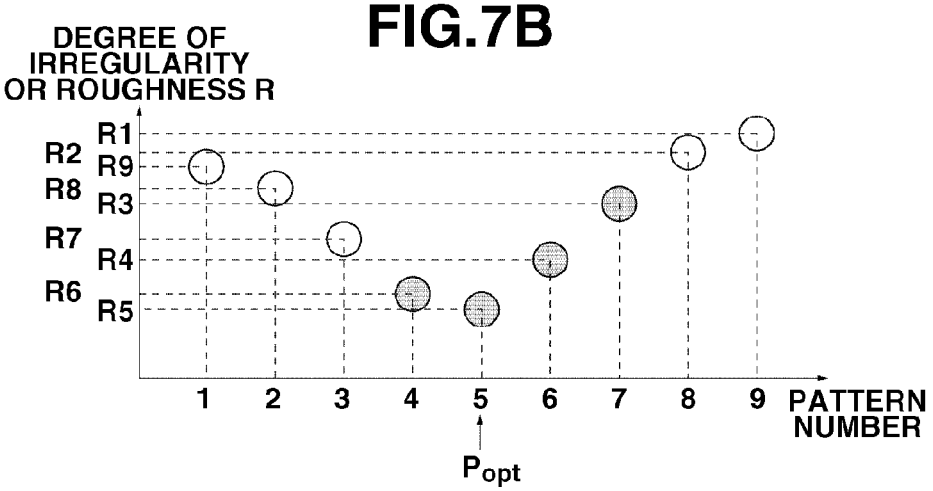
Figure 7C:
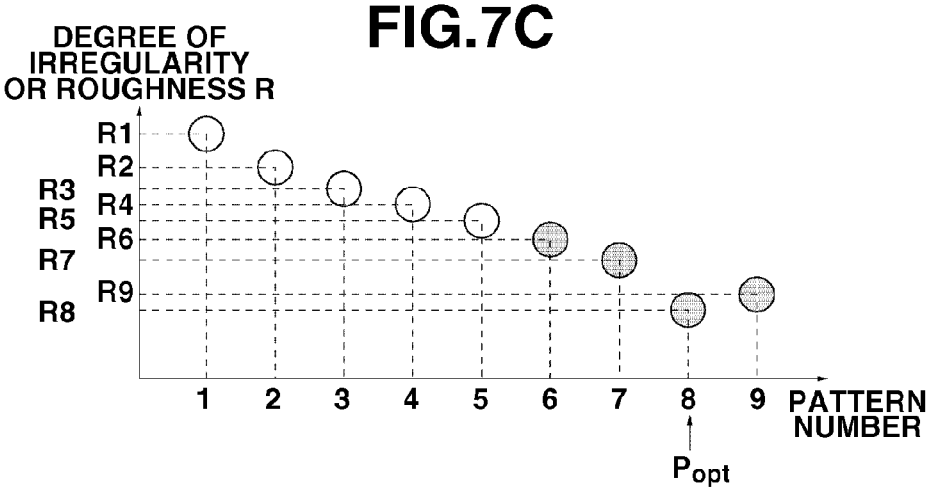

In step S315, the control unit 106 selects the degree of irregularity or roughness around the minimum degree of irregularity or roughness R. The number of degrees of irregularity or roughness R to be selected is four which includes the minimum degree of irregularity or roughness. FIGS. 7A to 7C respectively illustrate methods for selecting typical degrees of irregularity or roughness.

First, degrees of irregularity or roughness $R_{min+1}$ and $R_{min+1}$ at positions $P_{opt-1}$ and $P_{opt+1}$ adjacent to the position $P_{opt}$ having the minimum degree or irregularity or roughness $R_{min}$ detected in step S313 are compared with each other. Degrees of irregularity or roughness to be selected are switched, as illustrated in the following condition 1, depending on which of the degrees of irregularity or roughness $R_{min-1}$ and $R_{min+1}$ is greater:

$$\begin{cases} \text{when } R_{min-1} > R_{min+1} : R_{min-1}, R_{min}, R_{min+1}, R_{min+2} \\ \text{when } R_{min-1} \le R_{min+1} : R_{min-2}, R_{min-1}, R_{min}, R_{min+1} \end{cases} \quad \text{(Condition 1)}$$

FIGS. 7A to 7B illustrate the way four degrees of irregularity or roughness are selected from the condition 1.

As illustrated in FIG. 7C, the minimum degree of irregularity or roughness $R_{min}$ exists in the vicinity of an end of a pattern. In the example illustrated in FIG. 7C, $R_{min-1}>R_{min+1}$. Therefore, $R_{min-1}$, $R_{min}$, $R_{min+1}$, $R_{min+2}$ should be selected from the condition 1. However, $R_{min}$ exists in the vicinity of the end, so that $R_{min+2}$ cannot be selected. Therefore, the processing cannot be advanced any further. In such a case, four degrees of irregularity or roughness including $R_{min-2}$ are forcibly selected. If the four degrees of irregularity or roughness are selected by the above-mentioned method, the processing proceeds to step S316.

Figure 8:
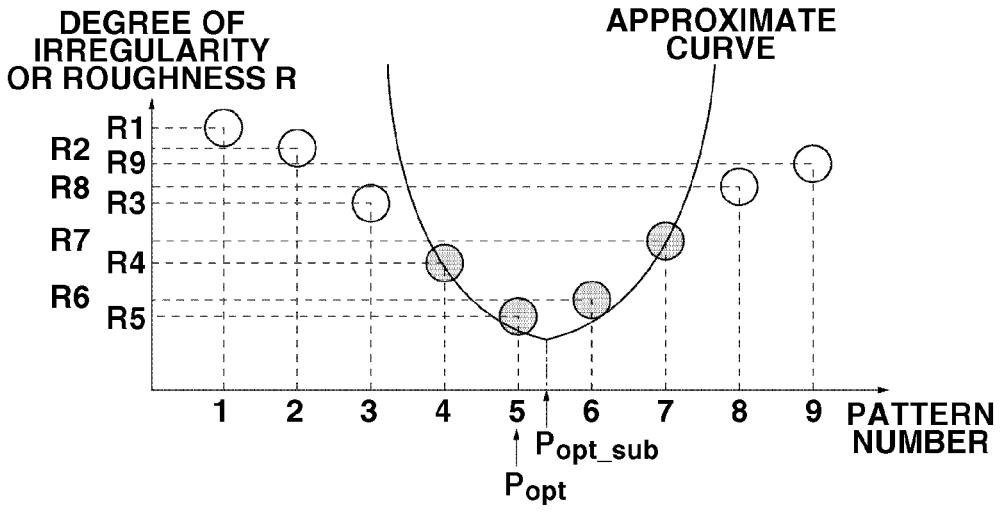
FIG. 8 illustrates a method for generating an approximate curve from the degrees of irregularity or roughness of patterns.

In step S316, the control unit 106 generates an approximate curve from the selected four degrees of irregularity or roughness, and determines a position at the minimum value of the approximate curve as an adjustment value for an optimum recording position at a sub-level, as illustrated in FIG. 8. A least-square method is applied as an approximation to a secondary curve $y=a_2x^2+a_1x+a_0$. More specifically, coefficients $a_2$, $a_1$, and $a_0$ at which $E=\Sigma(y-a_2x^2-a_1x-a_0)^2$ is minimized are found, so that an adjustment value $P_{opt_sub}=P_{opt}\ a_1/(2a_2)$ is determined at an optimum recording position at the sub-level and the determined adjustment value is stored in the storage unit 107. Then, the processing is terminated.

According to the present exemplary embodiment, the recording position adjustment chart includes a mark for detecting the inclination of the chart and the position of each of the patterns. The inclination of the chart can be corrected in the data based on the mark. In the present exemplary embodiment, even if the chart is placed in an inclined position on the document positioning plate 52 when read with the scanner, the recording position adjustment value can be accurately acquired.

According to a second exemplary embodiment of the present invention, an area inscribed in a pattern area is clipped, and is divided into division areas in a predetermined direction. An adjustment value for an optimum recording position is determined by an average of degrees of irregularity or roughness of the division areas. Therefore, the present exemplary embodiment differs from the first exemplary embodiment in a method for extracting a pattern area (step 909 in FIG. 9) and a method for measuring a degree of irregularity or roughness (step S911 in FIG. 9). The two methods that characterize the present exemplary embodiment will be described in detail. Components that have already been described in the first exemplary embodiment are assigned the same reference numerals and hence, the description thereof is not repeated.

Figure 9:
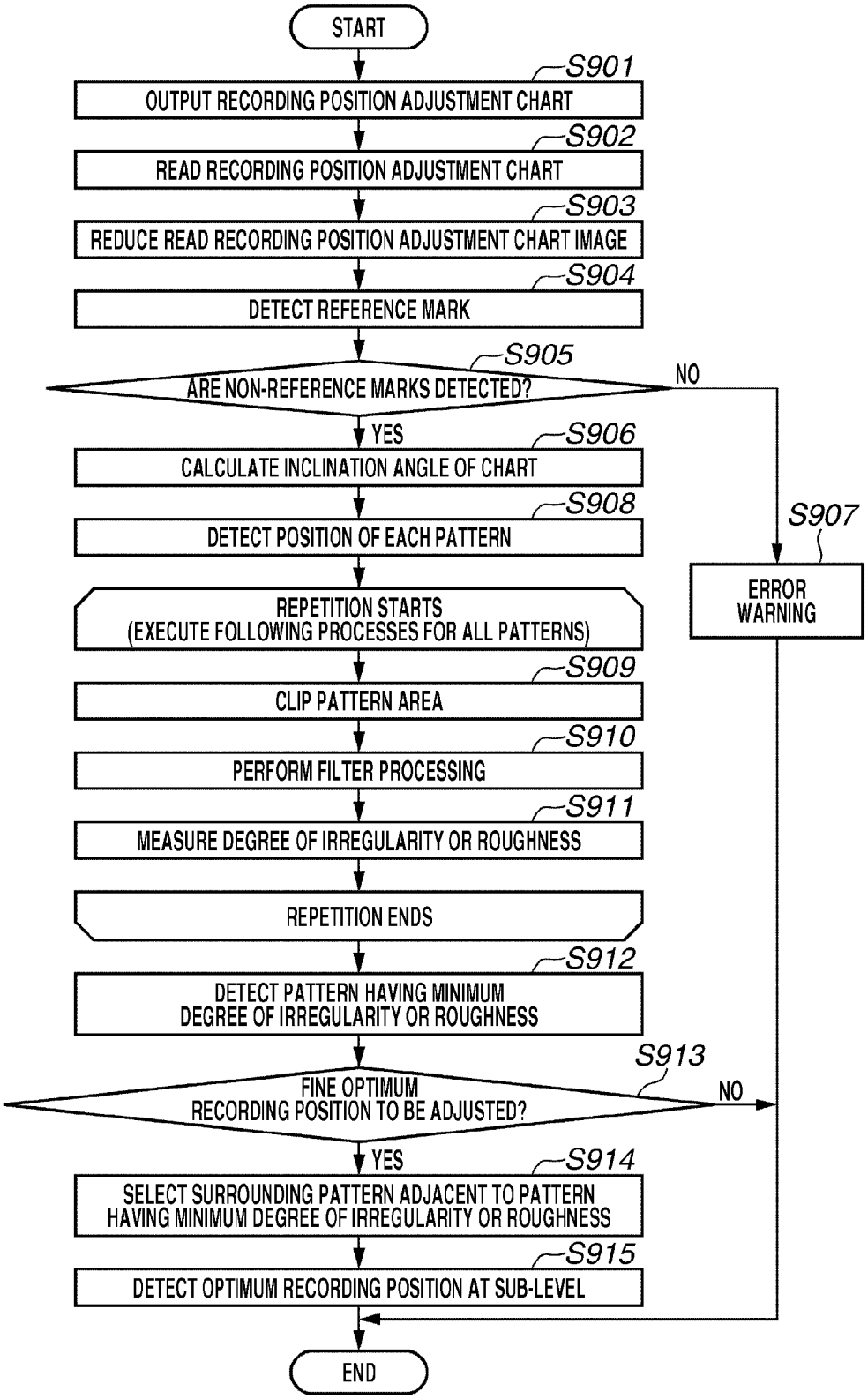
FIG. 9 is a flowchart illustrating recording position adjustment processing in a second exemplary embodiment.

First, processing of a pattern (203*b*) in which vertical fringes are generated when its recording position is shifted will be described. FIG. 9 is a flowchart illustrating recording position adjustment processing in the present exemplary embodiment. Processes other than processes in the method for extracting a pattern area (step S909) and the method for measuring a degree of irregularity or roughness (step S911) are similar to those in the first exemplary embodiment illustrated in FIG. 3.

In step S909, a control unit 106 clips, based on an upper left coordinate position of a pattern calculated in step S908, a rectangular area almost inscribed in the pattern.

Figure 10A:
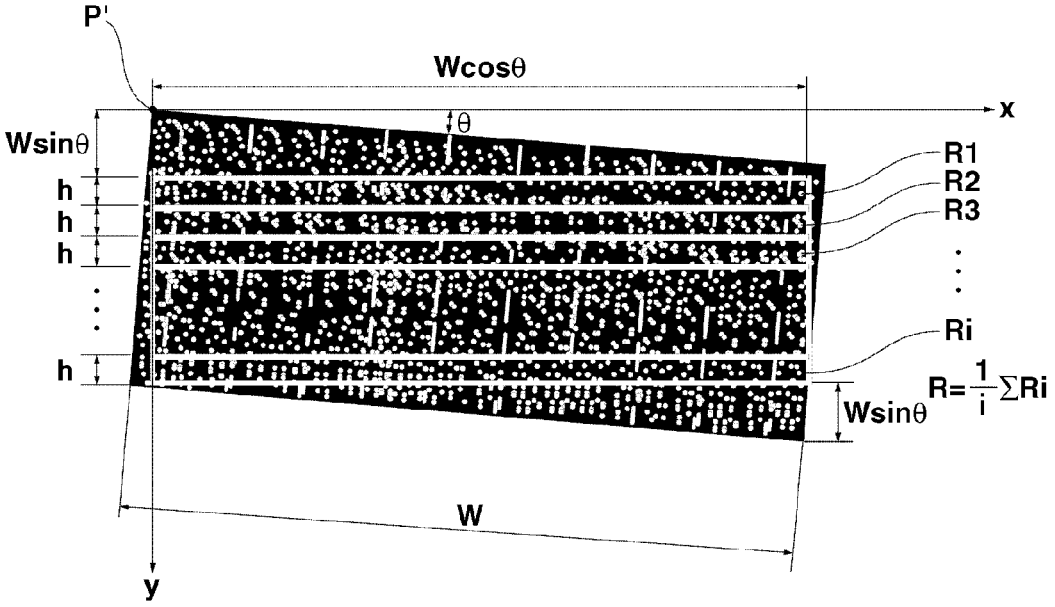
FIGS. 10A and 10B respectively illustrate methods for clipping rectangular areas in the second exemplary embodiment.

FIG. 10 illustrates a method for clipping the rectangular area in the present exemplary embodiment. As illustrated in FIG. 10A, if a rectangular area having a width W cos θ and a height (H−2W sin θ) is clipped from a position ($x_p'$, $y_p'$+W sin θ), where P' ($x_p'$, $y_p'$) is an upper left coordinate position of a pattern after affine transformation, and W and H are respectively the width and the height of the pattern, the rectangular area is almost inscribed in the pattern. In step S910, the control unit 106 executes filter processing for the area.

In step S911, the control unit 106 divides the pattern area clipped in step S909 into i division areas with a height h (h is one pixel or more and its maximum is five pixels) in the y-axis direction, and measures degrees of irregularity or roughness $R_1, R_2, \ldots, R_i$ using the foregoing equations (3) and (4) for the division areas. A mean value of the measured degrees of irregularity or roughness R in the i division areas is obtained using the following equation (7), and is taken as the final degree of irregularity or roughness.

$$R = \frac{1}{i}\sum_{m=1}^{i} R_n \tag{7}$$

The height of the division area is set to a maximum of five pixels because, when a mean value of pixel values is obtained on a line-by-line basis using the equation (3) with the pattern inclined, the mean values of the pixel values on a line-by-line basis need to be prevented from being almost constant on adjacent lines under the influence of a fringe pattern.

Processing of a pattern (203*a*, 203*c*) in which horizontal fringes are generated when its recording position is shifted will be then described. In step S909, the control unit 106 clips, based on the upper left coordinate position of the pattern calculated in step S908, a rectangular area almost inscribed in the pattern.

Figure 10B:
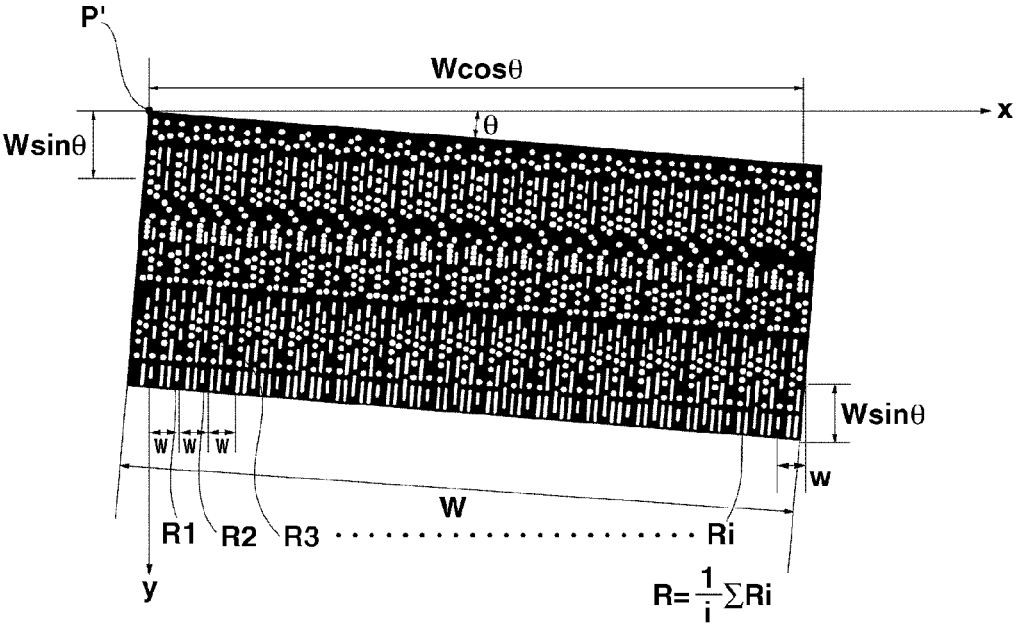

As illustrated in FIG. 10B, if a rectangular area having a width W cos θ and a height (H−2W sin θ) is clipped from a position ($x_p'$, $y_p'$+W sin θ), where P' ($x_p'$, $y_p'$) is an upper left coordinate position of a pattern after affine transformation, and W and H are respectively the width and the height of the pattern, the rectangular area is almost inscribed in the pattern. In step S910, the control unit 106 executes filter processing for the area.

In step S911, the control unit 106 divides the pattern area clipped in step S909 into i division areas with a width w (w is one pixel or more and a maximum of five pixels) in the x-axis direction, and measures degrees of irregularity or roughness $R_1, R_2, \ldots, R_i$ using the foregoing equations (5) and (6) for the division areas. A mean value of the measured degrees of irregularity or roughness R in the i division areas is obtained using the following equation (7), and is taken as the final degree of irregularity or roughness. The reason why the width of the division area is at a maximum five pixels is similar to a case where the pattern in which vertical fringes are generated is processed.

According to the present exemplary embodiment, the recording position adjustment value can be accurately acquired by dividing the clipped inscribed area and obtaining an average of the degrees of irregularity or roughness even if the recording position adjustment chart is placed in an inclined position on the document positioning plate when read with a scanner.

The objective of present invention of accurately determining a recording position adjustment value is achieved even when a recording chart is placed in an inclined position on a document positioning plate as long as the recording position adjustment value is determined based on the image data read by the reading unit such as the scanner unit. Therefore, the image processing apparatus according to the present invention may be a multifunctional recording apparatus including a printer unit and a scanner unit as well as an external apparatus connected to the recording apparatus via an external I/F. The above-mentioned processing can also be executed by both the recording apparatus and the external apparatus. In such a case, an image processing system including the recording apparatus and the external apparatus achieves the object of the present invention.

The object of the present invention is also achieved if a storage medium storing a program code of software implementing the above-mentioned function is supplied to an image processing system or an image processing apparatus and the system or a computer in the apparatus reads out and executes the program code stored in the storage medium. In this case, the program code itself read out of the storage medium implements a new function of the present invention. The storage medium storing the program code constitutes the present invention.

Storage media for supplying a program code include a flexible disk, a hard disk, an optical disk, a magneto-optical disk, a compact disk read-only memory (CD-ROM), a compact disk recordable (CD-R), a magnetic tape, a nonvolatile memory card, and a read-only memory (ROM). The program code read out by the computer is executed, to implement the function of the above-mentioned exemplary embodiment. In addition thereto, an operating system (OS) operating on the computer performs a part or the whole of actual processing based on an instruction to execute the program code. The function of the above-mentioned exemplary embodiment can also be implemented by the processing.

Although in the above-mentioned exemplary embodiment, the scanner unit reads the luminance of the recording position adjustment pattern to adjust the recording position, the recording position may be adjusted based on another optical information such as a reflection optical density (OD).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155670 filed Jun. 30, 2009, which is hereby incorporated by reference herein in its entirety.

What is claimed is:

1. An image processing apparatus, comprising:

a recording control unit configured to cause a recording head which discharges ink to record a recording position adjustment chart used for adjusting a recording position for a plurality of adjustment items where the recording head performs recording onto a recording medium, the recording position adjustment chart including a plurality of patterns for each of the plurality of adjustment items, wherein each of the plurality of patterns for one of the plurality of adjustment items corresponds to one of different shifting amounts of the recording position; and a determination unit configured to determine an adjustment amount for adjusting the recording position for the plurality of adjustment items based on pixel values of a plurality of pixels within an area of a pattern of the plurality of patterns in the recorded recording position adjustment chart, wherein the determination unit determines whether or not to use an adjustment amount that is between a first adjustment amount corresponding to a first shifting amount and a second adjustment amount corresponding to a second shifting amount, wherein the first shifting amount and the second shifting amount are adjacent shifting amounts in the different shifting amounts for adjusting the recording position based on the adjustment items, and wherein, in response to a determination to use an adjustment amount that is between the first adjustment amount and the second adjustment amount, the determination unit uses at least the first adjustment amount and the second adjustment amount to determine the adjustment amount that is between the first adjustment amount and the second adjustment amount.

2. The image processing apparatus according to claim 1, wherein the recording position adjustment chart includes a mark used for detecting an inclination of the recording position adjustment chart when the recording position adjustment chart is read, and wherein the image processing apparatus further comprises a correction unit configured to correct the inclination of the recording position adjustment chart based on the mark.

3. The image processing apparatus according to claim 1, further comprising a reading unit configured to read the recording position adjustment chart.

4. The image processing apparatus according to claim 1, wherein the determination unit clips, as an area of the pattern, a predetermined area from each image included in each of the plurality of patterns, and analyzes the clipped area to determine the adjustment amount.

5. The image processing apparatus according to claim 1, wherein the image processing apparatus is a recording apparatus which records an image on a recording medium using the recording head, and wherein the recording head performs the recording on the recording medium based on the adjustment amount determined by the determination unit.

6. The image processing apparatus according to claim 1, wherein the plurality of adjustment items includes a relative recording position adjustment between a recording position of the recording head for forward recording and a recording position of the recording head for backward recording.

7. The image processing apparatus according to claim 6, wherein the plurality of adjustment items includes a relative recording position adjustment between the recording position of the recording head for forward recording and the recording position of the recording head for backward recording and a relative recording position adjustment between a monochrome chip and a color chip of the recording head.

8. The image processing apparatus according to claim 6, wherein the determination unit determines that the determination unit uses the adjustment amount that is between the first adjustment amount and the second adjustment amount for at least one of the relative recording position adjustment between the recording position of the recording head for forward recording and the recording position of the recording head for backward recording and a relative recording position adjustment between a monochrome chip and a color chip of the recording head.

9. The image processing apparatus according to claim 1, wherein the determination unit determines the adjustment amount for adjusting the recording position for a plurality of adjustment items based on variation in luminance of the pattern based on the pixel values of a pattern of the plurality of pixels.

10. The image processing apparatus according to claim 1, wherein the adjustment amount that is between the first adjustment amount and the second adjustment amount is an adjustment amount in a finer unit than a predetermined unit corresponding to a unit of the different shifting amounts.

11. The image processing apparatus according to claim 1, wherein the adjustment amount that is between the first adjustment amount and the second adjustment amount is an adjustment amount at a sublevel which is a finer level than a predetermined level corresponding to a unit of the different shifting amounts.

12. An image processing method, comprising:

recording, using a recording head which discharges ink, a recording position adjustment chart used for adjusting a recording position for a plurality of adjustment items where the recording head performs recording onto a recording medium, the recording position adjustment chart including a plurality of patterns for each of the plurality of adjustment items, wherein each of the plurality of patterns for one of the plurality of adjustment items corresponds to one of different shifting amounts of the recording position; and determining an adjustment amount for adjusting the recording position for the plurality of adjustment items based on pixel values of a plurality of pixels within an area of a pattern of the plurality of patterns in the recorded recording position adjustment chart, wherein in the determining, it is determined whether or not an adjustment amount that is between a first adjustment amount corresponding to a first shifting amount and a second adjustment amount corresponding to a second shifting amount, wherein the first shifting amount and the second shifting amount are adjacent shifting amounts in the different shifting amounts, is used for adjusting the recording position, based on the adjustment items, and wherein the determining the adjustment amount comprises using at least the first adjustment amount and the second adjustment amount to determine the adjustment amount that is between the first adjustment amount and the second adjustment amount in response to a determination to use an adjustment amount that is between the first adjustment amount and the second adjustment amount.

13. The image processing method according to claim 12, wherein the plurality of adjustment items includes a relative recording position adjustment between a recording position of the recording head for forward recording and a recording position of the recording head for backward recording.

14. The image processing method according to claim 13, wherein the plurality of adjustment items includes a relative recording position adjustment between the recording position of the recording head for forward recording and the recording position of the recording head for backward recording and a relative recording position adjustment between a monochrome chip and a color chip of the recording head.

15. The image processing method according to claim 14, wherein in the determining, it is determined that the adjustment amount that is between the first adjustment amount and the second adjustment amount is used for at least one of the relative recording position adjustment between the recording position of the recording head for forward recording and the recording position of the recording head for backward recording and the relative recording position adjustment between the monochrome chip and the color chip of the recording head.

16. The image processing method according to claim 12, wherein in the determining, the adjustment amount for adjusting the recording position for a plurality of adjustment items is determined based on variation in luminance of the pattern based on the pixel values of the plurality of pixels within the pattern.

* * * * *